US012692456B2

(12) United States Patent
Matsubara et al.

(10) Patent No.: US 12,692,456 B2
(45) Date of Patent: Jul. 28, 2026

(54) LUBRICANT COMPOSITION

(71) Applicant: IDEMITSU KOSAN CO.,LTD., Chiyoda-ku (JP)

(72) Inventors: Kazushige Matsubara, Chiba (JP); Hiroyuki Tatsumi, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 17/907,049

(22) PCT Filed: Mar. 25, 2021

(86) PCT No.: PCT/JP2021/012722

§ 371 (c)(1),
(2) Date: Sep. 22, 2022

(87) PCT Pub. No.: WO2021/193869

PCT Pub. Date: Sep. 30, 2021

(65) Prior Publication Data

US 2023/0120889 A1 Apr. 20, 2023

(30) Foreign Application Priority Data

Mar. 27, 2020 (JP) ..... 2020-058887

(51) Int. Cl.

| | |
|---|---|
| ***C10M 169/04*** | (2006.01) |
| ***C10M 135/36*** | (2006.01) |
| ***C10M 137/02*** | (2006.01) |
| ***C10M 141/10*** | (2006.01) |
| *C10N 40/00* | (2006.01) |

(52) U.S. Cl.

CPC ..... *C10M 141/10* (2013.01); *C10M 135/36* (2013.01); *C10M 137/02* (2013.01); *C10M 169/04* (2013.01); *C10M 2203/003* (2013.01); *C10M 2219/106* (2013.01); *C10M 2223/049* (2013.01); *C10N 2040/40* (2020.05)

(58) Field of Classification Search

CPC ..... C10M 141/10; C10M 135/36; C10M 137/02; C10M 169/04; C10M 2203/003; C10M 2219/106; C10M 2223/049; C10M 157/08; C10M 2203/1025; C10M 2207/026; C10M 2209/084; C10M 2215/064; C10M 2215/223; C10M 2219/046; C10M 2223/047; C10N 2040/40; C10N 2030/02; C10N 2030/06; C10N 2030/12; C10N 2040/16

See application file for complete search history.

(56) References Cited

U.S. PATENT DOCUMENTS

| | | | | |
|---|---|---|---|---|
| 2011/0118158 | A1 | 5/2011 | Shishikura et al. | |
| 2017/0145337 | A1* | 5/2017 | Masuda | C10M 135/20 |
| 2018/0282654 | A1 | 10/2018 | Abraham et al. | |
| 2021/0292676 | A1* | 9/2021 | Kubo | C10M 135/36 |

FOREIGN PATENT DOCUMENTS

| | | | |
|---|---|---|---|
| JP | 11-171892 | A | 6/1999 |
| JP | 2008-285682 | A | 11/2008 |
| JP | 2011-63734 | A | 3/2011 |
| JP | 2012-207083 | A | 10/2012 |
| JP | 2020-172642 | A | 10/2020 |
| WO | WO 2009/119669 | A1 | 10/2009 |
| WO | WO 2015/194236 | A1 | 12/2015 |
| WO | WO 2016/009670 | A1 | 1/2016 |

OTHER PUBLICATIONS

International Search Report mailed on Jun. 29, 2021 in PCT/JP2021/012722 filed on Mar. 25, 2021 (2 pages).

Combined Chinese Office Action and Search Report issued Nov. 18, 2023 in Chinese Patent Application No. 202180023959.5 (with unedited computer-generated English translation), 17 pages.

Extended European Search Report issued Mar. 22, 2024 in European Patent Application No. 21775324.3, 7 pages.

Japanese Office Action issued Jun. 25, 2024 in Patent Application 2022-510696 (with English language translation), 4 pages.

Chinese Office Action mailed on Jul. 24, 2024 issued in Chinese Patent Application 202180023959.5, with English Translation, total 17 pages.

Indian Office Action issued Oct. 16, 2025 in corresponding Indian Patent Application No. 202247054998, 5 pages.

European Office Action issued Feb. 11, 2025 in European Patent Application No. 21775324.3, 5 pgs.

* cited by examiner

*Primary Examiner* — Taiwo Oladapo

(74) *Attorney, Agent, or Firm* — Oblon, McClelland, Maier & Neustadt, L.L.P.

(57) ABSTRACT

A lubricating oil composition containing a phosphite ester derivative (A) having at least one alkyl group having 1 to 20 carbon atoms in which one —$CH_2$— group is substituted with a —S— group, and a thiadiazole derivative (B). A method of lubricating an electric drive unit with the lubricating oil composition and an electric drive unit including the lubricating oil composition.

12 Claims, No Drawings

LUBRICANT COMPOSITION

CROSS REFERENCE TO RELATED APPLICATIONS

This application is a National Stage entry under 35 U.S.C. § 371 of PCT/JP2021/012722, filed on Mar. 25, 2021, and claims priority to Japanese Patent Application No. 2020-058887, filed on Mar. 27, 2020. The entire contents of both are incorporated herein by reference.

TECHNICAL FIELD

The present invention relates to a lubricating oil composition and an electric drive unit using the lubricating oil composition.

BACKGROUND ART

In electric vehicles and hybrid vehicles, there has been a demand for reduction in size and weight by packaging a gear box and an electric motor in order to reduce the size and weight. In this application, a lubricating oil composition having both insulation performance and cooling performance in addition to lubricity is required so as to be shared as a gear oil and an electric motor oil. Therefore, optimization of a base oil and blending of a zinc dithiophosphate, a triarylthiophosphate, a phosphorus compound and an ashless dispersant to be added have been studied (PTLs 1 to 3).

CITATION LIST

Patent Literature

PTL 1: JP 2008-285682 A
PTL 2: JP 2011-63734 A
PTL 3: JP 2012-207083 A

SUMMARY OF INVENTION

Technical Problem

In recent years, development of an electric drive unit including a motor, a gear box, and an inverter has been advanced, and a lubricating oil composition optimized for the electric drive unit has been required. In the electric drive unit, there is an increasing demand for miniaturization of a package due to limitation of a layout in a vehicle body.

For miniaturization of the package, a gear box is also reduced in size, a diameter of a gear used is reduced, and a tooth width is also reduced. Due to the miniaturization, a force applied to a tooth surface also increases, and a gear oil is required to maintain high durability of the gear, and a sulfur-based extreme pressure resistance agent is required to achieve the requirement.

Related-art lubricating oils disclosed in PTLs 1 to 3 have problems in that extreme pressure resistance is insufficient and performance of improving durability and wear resistance does not satisfy requirements.

In an electric drive unit, since an electric circuit and a lubricating oil may come into contact with each other, the lubricating oil is required to have a high volume resistivity.

Therefore, improvement of these characteristics has been required.

The present invention has been made in view of the above circumstances, and an object thereof is to provide a lubricating oil composition having high extreme pressure resistance, causing durability and wear resistance to be exhibited at high levels, and exhibiting high volume resistivity, and an electric drive unit using the lubricating oil composition.

Solution to Problem

In order to solve the above problems, the present inventors provide the following [1] to [11].

[1] A lubricating oil composition containing:

a phosphite ester derivative (A) having at least one alkyl group having 1 or more and 20 or less carbon atoms, in which one —$CH_2$— group is substituted with a —S— group; and a thiadiazole derivative (B).

[2] The lubricating oil composition according to [1], wherein the phosphite ester derivative (A) contains at least one compound of compounds represented by general formulae (A1) and (A2).

(A1)

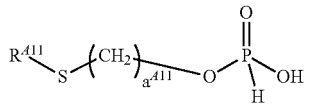

(A2)

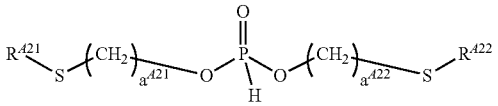

(In the formulae, $R^{A11}$, $R^{A21}$, and $R^{A22}$ each independently represent an alkyl group having 1 or more and 20 or less carbon atoms, or a hydrogen atom, and $a^{A11}$, $a^{A21}$, and $a^{A22}$ each independently represent an integer of 1 or more and 8 or less.)

[3] The lubricating oil composition according to [1] or [2], wherein the thiadiazole derivative (B) contains at least one compound of compounds represented by general formulae (B1) to (B3).

(B1)

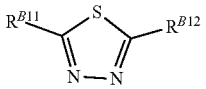

(B2)

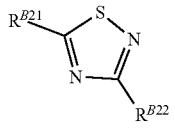

(B3)

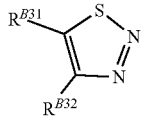

(In the formulae, $R^{B11}$, $R^{B12}$, $R^{B21}$, $R^{B22}$, $R^{B31}$, and $R^{B32}$ each independently represent a hydrogen atom, a hydroxy group, a —SH group, an —$NH_2$ group, or an organic group.)

[4] The lubricating oil composition according to any one of [1] to [3], further comprising a base oil (C).

[5] The lubricating oil composition according to any one of [1] to [4], wherein a content of a compound represented by the general formula (A1) in the phosphite ester derivative (A) in the lubricating oil composition is 5% by mass or more and 95% by mass or less.

[6] The lubricating oil composition according to any one of [1] to [5], wherein a content of the phosphite ester derivative (A) is 0.05% by mass or more and 1.0% by mass or less based on a total amount of the lubricating oil composition.

[7] The lubricating oil composition according to any one of [1] to [6], wherein a content of a compound represented by the general formula (A1) in the phosphite ester derivative (A) in the lubricating oil composition is 70% by mass or more and 95% by mass or less.

[8] The lubricating oil composition according to any one of [1] to [7], wherein a content of the thiadiazole derivative (B) is 0.05% by mass or more and 1.0% by mass or less based on the total amount of the lubricating oil composition.

[9] The lubricating oil composition according to any one of [1] to [8], wherein a phosphorus atom-equivalent content ($X_{AP}$ ppm by mass) of the phosphite ester derivative (A) based on the total amount of the lubricating oil composition is 50 ppm by mass or more and 10,000 ppm by mass or less.

[10] The lubricating oil composition according to any one of [1] to [9], wherein a sulfur atom-equivalent content ($X_{BS}$ ppm by mass) of the thiadiazole derivative (B) based on the total amount of the lubricating oil composition is 100 ppm by mass or more and 10,000 ppm by mass or less.

[11] The lubricating oil composition according to [10], wherein the $X_{AP}$ and the $X_{BS}$ satisfies a relationship of $0.05 \leq X_{AP}/X_{BS} \leq 5.00$.

[12] The lubricating oil composition according to any one of [1] to [11], wherein a sum of a sulfur atom-equivalent content of the phosphite ester derivative (A) and the sulfur atom-equivalent content of the thiadiazole derivative (B) is 100 ppm by mass or more and 10,000 ppm by mass or less based on the total amount of the composition.

[13] The lubricating oil composition according to any one of [1] to [12], which is used in an electric drive unit.

[14] An electric drive unit using the lubricating oil composition according to any one of [1] to [12].

Advantageous Effects of Invention

According to the present invention, it is possible to provide a lubricating oil composition having high extreme pressure resistance and causing durability and wear resistance to be exhibited at high levels, and an electric drive unit using the lubricating oil composition.

DESCRIPTION OF EMBODIMENTS

Hereinafter, a lubricating oil composition and an electric drive unit using the lubricating oil composition according to an embodiment of the present invention will be described. The lubricating oil composition and the electric drive unit using the lubricating oil composition according to the embodiment of the present invention are merely one embodiment of the present invention, and the present invention is not limited to the lubricating oil composition and the electric drive unit using the lubricating oil composition according to the embodiment of the present invention.

[Lubricating Oil Composition]

The lubricating oil composition according to the present invention contains a phosphite ester derivative (A) having at least one alkyl group having 1 or more and 20 or less carbon atoms, in which one —$CH_2$— group is substituted with a —S— group, and a thiadiazole derivative (B).

<Phosphite Ester Derivative (A)>

The phosphite ester derivative (A) is a compound having at least one alkyl group having 1 or more and 20 or less carbon atoms in which one —$CH_2$— group is substituted with a —S— group. Only one type of the phosphite ester derivative (A) may be used, or two or more types of the phosphite ester derivatives (A) may be used. There may be one alkyl group or two alkyl groups in the same molecule. A compound having one alkyl group and a compound having two alkyl groups may be used alone, or the compound having one alkyl group and the compound having two alkyl groups may be used in combination.

The phosphite ester derivative (A) has both a characteristic as an anti-wear agent generated by phosphorous acid and a characteristic as an extreme pressure resistant agent generated by the alkyl group having 1 or more and 20 or less carbon atoms in which substitution with the —S— group is completed. Therefore, these characteristics cannot be compatible unless the phosphite ester derivative (A) is contained.

It is also preferable to optimize a content in order to further improve these characteristics.

A lower limit of the content of the phosphite ester derivative (A) is preferably 0.05% by mass, more preferably 0.10% by mass, still more preferably 0.20% by mass, yet still more preferably 0.25% by mass, and particularly preferably 0.28% by mass, based on a total amount of the lubricating oil composition, from a viewpoint of exhibiting wear resistance and lubricity under extreme pressure. An upper limit of the content of the phosphite ester derivative (A) is preferably 1.00% by mass, more preferably 0.70% by mass, still more preferably 0.50% by mass, yet still more preferably 0.40% by mass, particularly preferably 0.35% by mass, and most preferably 0.32% by mass, based on the total amount of the lubricating oil composition, from a viewpoint of volume resistivity.

The phosphite ester derivative (A) may have a partial structure represented by the general formula (A0-1), or may have only one partial structure represented by the general formula (A0-1) in the molecule, or may have two partial structures represented by the general formula (A0-1) in the molecule. In this case, when a plurality of $R^{A01}$'s and $R^{A02}$'s are present in the same molecule, they may be the same as or different from each other.

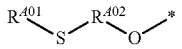

(A0-1)

(In the formula, $R^{A01}$ represents a hydrogen atom or a monovalent organic group having 1 or more and 20 or less carbon atoms, $R^{A02}$ represents a divalent organic group, and * represents another atom to which an oxygen atom of a group represented by the general formula (A0-1) is bonded.)

$R^{A01}$ is preferably an alkyl group having 1 or more and 20 or less carbon atoms, and one or more —$CH_2$— may be substituted with —O—, —S—, —COO—, —CSO—, —OCS—, —CH═CH— or —C≡C—. $R^{A01}$ may be linear or branched, and is preferably linear from a viewpoint of improving lubricity of the lubricating oil composition under extreme pressure. The number of carbon atoms in $R^{A01}$ is more preferably 2 or more, still more preferably 4 or more, and yet still more preferably 6 or more, and is more preferably 18 or less, still more preferably 16 or less, even more preferably 12 or less, yet still more preferably 10 or less, and particularly preferably 8.

$R^{A02}$ is preferably an alkylene group having 2 or more and 20 or less carbon atoms, which may contain a ring structure, from the viewpoint of improving lubricity of the lubricating oil composition under extreme pressure, and one or more —$CH_2$— in the alkylene group may be substituted with —O—, —S—, —COO—, —OCO—, —CSO—, —OCS—, —CH=CH— or —C≡C—. $R^{A02}$ is preferably a linear alkylene group having 2 or more and 8 or less carbon atoms, more preferably —$C_2H_4$— or —$C_2H_4$—, and still more preferably —$C_2H_4$—.

The phosphite ester derivative (A) preferably contains at least one compound selected from compounds represented by the general formulae (A1) and (A2), and preferably does not substantially contain a compound other than the compounds represented by the general formulae (A1) and (A2).

(A1)

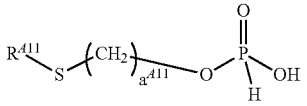

(A2)

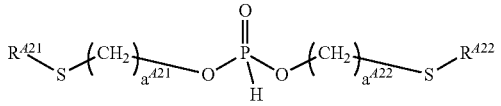

(In the formulae, $R^{A11}$, $R^{A21}$, and $R^{A22}$ each independently represent an alkyl group having 1 or more and 20 or less carbon atoms, or a hydrogen atom, and $a^{A11}$, $a^{A21}$, and $a^{A22}$ each independently represent an integer of 1 or more and 8 or less.)

In the formulae, $R^{A11}$, $R^{A21}$, and $R^{A22}$ may each be linear or branched independently from the viewpoint of improving lubricity of the lubricating oil composition under extreme pressure, and are preferably linear. The number of carbon atoms in each of $R^{A11}$, $R^{A21}$, and $R^{A22}$ is preferably 2 or more, more preferably 4 or more, and still more preferably 6 or more, and is preferably 18 or less, more preferably 16 or less, still more preferably 12 or less, even more preferably 10 or less, and yet still more preferably 8. Each of $a^{A11}$, $a^{A21}$, and $a^{A22}$ is independently preferably 1, 2, or 4, and more preferably 2.

When the phosphite ester derivative (A) used in the present invention is an acidic phosphite ester, the phosphite ester derivative (A) is preferably an amine salt. Examples of amines used for forming the amine salt include primary amines, secondary amines, tertiary amines, and polyalkyleneamines, such as ethylenediamine, diethylenetriamine, triethylenetetramine, tetraethylenepentamine, pentaethylenehexamine, hexaethyleneheptamine, heptaethyleneoctamine, tetrapropylenepentamine, and hexabutyleneheptamine.

The lower limit of the content of the phosphite ester derivative (A) is preferably 0.05% by mass, more preferably 0.10% by mass, still more preferably 0.20% by mass, yet still more preferably 0.25% by mass, and particularly preferably 0.28% by mass, based on the total amount of the lubricating oil composition, from the viewpoint of exhibiting wear resistance and lubricity under extreme pressure. The upper limit of the content of the phosphite ester derivative (A) is preferably 1.00% by mass, more preferably 0.80% by mass, still more preferably 0.50% by mass, even more preferably 0.40% by mass, yet still more preferably 0.35% by mass, and particularly preferably 0.32% by mass, based on the total amount of the lubricating oil composition.

A lower limit of a total content of the compounds represented by the general formulae (A1) and (A2) is preferably 80% by mass, more preferably 90% by mass, still more preferably 95% by mass, yet still more preferably 98% by mass, and particularly preferably substantially 100% by mass, from the viewpoint of exhibiting wear resistance and lubricity under extreme pressure, and an upper limit is not particularly limited, and is preferably substantially 100% by mass, based on a total amount of the phosphite ester derivative (A). In the present specification, "substantially" means that by-products and the like unintentionally generated during production are excluded.

A lower limit of a content of a compound represented by the general formula (A1) is preferably 0.05% by mass, more preferably 0.10% by mass, still more preferably 0.20% by mass, yet still more preferably 0.23% by mass, and particularly preferably 0.25% by mass, based on the total amount of the lubricating oil composition, from the viewpoint of exhibiting wear resistance and lubricity under extreme pressure. An upper limit of the content of the compound represented by the general formula (A1) is preferably 1.00% by mass, more preferably 0.70% by mass, still more preferably 0.50% by mass, yet still more preferably 0.40% by mass, and particularly preferably 0.30% by mass, based on the total amount of the lubricating oil composition, from the viewpoint of volume resistivity.

A lower limit of a content of a compound represented by the general formula (A2) is preferably 0.01% by mass, and more preferably 0.02% by mass, based on the total amount of the lubricating oil composition, from the viewpoint of exhibiting wear resistance and lubricity under extreme pressure. An upper limit of the content of the compound represented by the general formula (A2) is preferably 0.10% by mass, more preferably 0.08% by mass, and still more preferably 0.05% by mass, from the viewpoint of volume resistivity.

The phosphite ester derivative (A) is preferably a mixture of only the compounds represented by the general formulae (A1) and (A2), and the lower limit of the content of the compound represented by the general formula (A1) is preferably 5% by mass, more preferably 50% by mass, still more preferably 70% by mass, yet still more preferably 80% by mass, and particularly preferably 85% by mass, based on the total amount of the phosphite ester derivative (A), from the viewpoint of exhibiting wear resistance and lubricity under extreme pressure. The upper limit of the content of the compound represented by the general formula (A1) is preferably 98% by mass, more preferably 95% by mass, and still more preferably 92% by mass, based on the total amount of the phosphite ester derivative (A), from a viewpoint of balance between wear resistance and lubricity under extreme pressure.

A lower limit of a phosphorus atom-equivalent content ($X_{AP}$) of the phosphite ester derivative (A) based on the total amount of the lubricating oil composition is preferably 50 ppm by mass, more preferably 100 ppm by mass, still more preferably 200 ppm by mass, and yet still more preferably 250 ppm by mass, from the viewpoint of exhibiting wear resistance and lubricity under extreme pressure. An upper limit of the phosphorus atom-equivalent content ($X_{AP}$) is preferably 10,000 ppm by mass, more preferably 5,000 ppm by mass, still more preferably 1,000 ppm by mass, yet still more preferably 700 ppm by mass, and particularly preferably 500 ppm by mass, from the viewpoint of volume resistivity.

A lower limit of a sulfur atom-equivalent content ($X_{AP}$) of the phosphite ester derivative (A) based on the total amount of the lubricating oil composition is preferably 50 ppm by mass, more preferably 100 ppm by mass, still more preferably 200 ppm by mass, and yet still more preferably 250 ppm by mass, from the viewpoint of exhibiting wear resistance and lubricity under extreme pressure. An upper limit of the sulfur atom-equivalent content ($X_{AP}$) is preferably 10,000 ppm by mass, more preferably 5,000 ppm by mass, still more preferably 1,000 ppm by mass, yet still more preferably 700 ppm by mass, and particularly preferably 500 ppm by mass, from the viewpoint of volume resistivity.

<Thiadiazole Derivative (B)>

When the thiadiazole derivative (B) is not contained, an effect of improving lubricity of the lubricating oil composition under extreme pressure cannot be attained.

Only one type of thiadiazole derivative (B) may be used, or two or more types of thiadiazole derivatives (B) may be used.

The thiadiazole derivative (B) is preferably a compound represented by the general formulae (B1) to (B3), and more preferably a compound represented by the general formula (B1), from the viewpoint of improving lubricity of the lubricating oil composition under extreme pressure.

(B1)

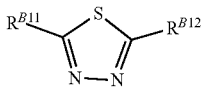

(B2)

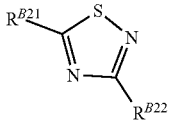

(B3)

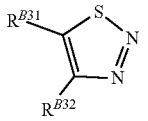

(In the formulae, $R^{B11}$, $R^{B12}$, $R^{B21}$, $R^{B22}$, $R^{B31}$, and $R^{B32}$ each independently represent a hydrogen atom, a hydroxy group, a —SH group, an —$NH_2$ group, or an organic group.)

The organic group may be a substituent containing a carbon atom without being particularly limited, in which —$X^{B41}$—$R^{B41}$ is preferable from the viewpoint of improving lubricity of the lubricating oil composition under extreme pressure. The $X^{B41}$ is preferably —O—, —CO—, —COO—, —OCO—, —NH—, —NHCO—, —CONH—, —S—, —S—S—, or a single bond, and is more preferably —NH—, —S—, —S—S—, or a single bond, still more preferably —S— or —S—S—, and yet still more preferably —S—S, from the viewpoint of the effect of improving lubricity under extreme pressure.

When a plurality of $X^{B41}$'s and/or $R^{B41}$'s are present in the molecule, they may be the same as or different from each other.

$R^{B41}$ is preferably an alkyl group having 1 or more and 30 or less carbon atoms, and —$CH_2$— in the alkyl group may be substituted with —O—, —CO—, —COO—, —OCO—, —NH—, —NHCO—, —CONH—, —CH═CH—, —C≡C—, or —S—, and may be linear or branched.

The number of carbon atoms in $R^{B41}$ is more preferably 4 or more and 20 or less, still more preferably 6 or more and 18 or less, and yet still more preferably 8 or more and 12 or less. $R^{B41}$ is preferably branched, and preferably has a tertiary carbon or a quaternary carbon in the substituent.

From the viewpoint of improving lubricity of the lubricating oil composition under extreme pressure, the thiadiazole derivative (B) is preferably a compound having a —S— group or a —S—S— group as a linking group or a compound having a mercapto group, such as 2,5-bis(t-nonylthio)-1,3,4-thiadiazole, 2,5-bis(dimethylhexylthio)-1,3,4-thiadiazole, 2,5-bis(octadecenylthio)-1,3,4-thiadiazole, 2,5-bis(methylhexadecenylthio)-1,3,4-thiadiazole, 2,5-bis(2-hydroxyoctadecylthio)-1,3,4-thiadiazole, 2,5-bis(n-octoxycarbonylmethylthio)-1,3,4-thiadiazole, 2-mercapto-5-(2-ethylhexylthio)-1,3,4-thiadiazole, 2-mercapto-5-(t-nonylthio)-1,3,4-thiadiazole, 2,4-bis(2-ethylhexyldithio) thiazole, 2,5-bis(t-nonyldithio)-1,3,4-thiadiazole, 2,5-bis(dimethylhexyldithio)-1,3,4-thiadiazole, 2,5-bis(octadecenyldithio)-1,3,4-thiadiazole, 2,5-bis(methylhexadecenyldithio)-1,3,4-thiadiazole, 2,5-bis(2-hydroxyoctadecyldithio)-1,3,4-thiadiazole, 2,5-bis(n-octoxycarbonylmethyldithio)-1,3,4-thiadiazole, 2-mercapto-5-(2-ethylhexyldithio)-1,3,4-thiadiazole, 2-mercapto-5-(t-nonyldithio)-1,3,4-thiadiazole, 2,5-bis(t-nonylamino)-1,3,4-thiadiazole, 2,5-bis(dimethylhexylamino)-1,3,4-thiadiazole, 2,5-bis(octadecenylamino)-1,3,4-thiadiazole, 2,5-bis(methylhexadecenylamino)-1,3,4-thiadiazole, 2,5-bis(2-hydroxyoctadecylamino)-1,3,4-thiadiazole, 2,5-bis(n-octoxycarbonylmethylamino)-1,3,4-thiadiazole, 2-amino-5-(2-ethylhexylamino)-1,3,4-thiadiazole, 2-amino-5-(t-nonylamino)-1,3,4-thiadiazole, 2,5-bis(t-nonyl)-1,3,4-thiadiazole, 2,5-bis(dimethylhexyl)-1,3,4-thiadiazole, 2,5-bis(octadecenyl)-1,3,4-thiadiazole, 2,5-bis(methylhexadecenyl)-1,3,4-thiadiazole, 2-octyl-thiazoline, 2,5-bis(2-hydroxyoctadecyl)-1,3,4-thiadiazole, 2,5-bis(n-octoxycarbonylmethyl)-1,3,4-thiadiazole, 2-(2-ethylhexyl)-1,3,4-thiadiazole, and 2-(t-nonyl)-1,3,4-thiadiazole. The thiadiazole derivative (B) is more preferably a compound having a —S— group or a —S—S— group as a linking group or a compound having a mercapto group, such as 2,5-bis(t-nonylthio)-1,3,4-thiadiazole, 2,5-bis(dimethylhexylthio)-1,3,4-thiadiazole, 2,5-bis(octadecenylthio)-1,3,4-thiadiazole, 2,5-bis(methylhexadecenylthio)-1,3,4-thiadiazole, 2,5-bis(2-hydroxyoctadecylthio)-1,3,4-thiadiazole, 2,5-bis(n-octoxycarbonylmethylthio)-1,3,4-thiadiazole, 2-mercapto-5-(2-ethylhexylthio)-1,3,4-thiadiazole, 2-mercapto-5-(t-nonylthio)-1,3,4-thiadiazole, 2,4-bis(2-ethylhexyldithio) thiazole, 2,5-bis(t-nonyldithio)-1,3,4-thiadiazole, 2,5-bis(dimethylhexyldithio)-1,3,4-thiadiazole, 2,5-bis(octadecenyldithio)-1,3,4-thiadiazole, 2,5-bis(methylhexadecenyldithio)-1,3,4-thiadiazole, 2,5-bis(2-hydroxyoctadecyldithio)-1,3,4-thiadiazole, 2,5-bis(n-octoxycarbonylmethyldithio)-1,3,4-thiadiazole, 2-mercapto-5-(2-ethylhexyldithio)-1,3,4-thiadiazole, and 2-mercapto-5-(t-nonyldithio)-1,3,4-thiadiazole. The thiadiazole derivative (B) is still more preferably a compound having a —S—S— group as a linking group, such as 2,4-bis(2-ethylhexyldithio)thiazole, 2,5-bis(t-nonyldithio)-1,3,4-thiadiazole, 2,5-bis(dimethylhexyldithio)-1,3,4-thiadiazole, 2,5-bis(octadecenyldithio)-1,3,4-thiadiazole, 2,5-bis(methylhexadecenyldithio)-1,3,4-thiadiazole, 2,5-bis(2-hydroxyoctadecyldithio)-1,3,4-thiadiazole, 2,5-bis(n-octoxycarbonylmethyldithio)-1,3,4-thiadiazole, 2-mercapto-5-(2-ethylhexyldithio)-1,3,4-thiadiazole, and 2-mercapto-5-(t-nonyldithio)-1,3,4-thiadiazole.

A lower limit of a content of the thiadiazole derivative (B) is preferably 0.05% by mass, more preferably 0.10% by mass, still more preferably 0.15% by mass, and yet still more preferably 0.18% by mass, based on the total amount of the lubricating oil composition, from the viewpoint of exhibiting lubricity under extreme pressure. An upper limit of the content of the thiadiazole derivative (B) is preferably 1.00% by mass, more preferably 0.70% by mass, still more preferably 0.50% by mass, even more preferably 0.40% by mass, yet still more preferably 0.35% by mass, and particularly preferably 0.32% by mass, based on the total amount of the lubricating oil composition, from the viewpoint of volume resistivity.

A lower limit of a content of a compound represented by the general formula (B1) is preferably 0.05% by mass, more preferably 0.10% by mass, still more preferably 0.15% by mass, and yet still more preferably 0.18% by mass, based on the total amount of the lubricating oil composition, from the viewpoint of exhibiting lubricity under extreme pressure. An upper limit of the content of the compound represented by the general formula (B1) is preferably 1.00% by mass, more preferably 0.70% by mass, still more preferably 0.50% by mass, even more preferably 0.40% by mass, yet still more preferably 0.35% by mass, and particularly preferably 0.32% by mass, based on the total amount of the lubricating oil composition, from the viewpoint of volume resistivity.

A lower limit of a sulfur atom-equivalent content ($X_{BS}$) of the thiadiazole derivative (B) based on the total amount of the lubricating oil composition is preferably 50 ppm by mass, more preferably 100 ppm by mass, still more preferably 300 ppm by mass, yet still more preferably 500 ppm by mass, and particularly preferably 600 ppm by mass, from the viewpoint of exhibiting lubricity under extreme pressure. An upper limit of the sulfur atom-equivalent content ($X_{BS}$) is preferably 10,000 ppm by mass, more preferably 5,000 ppm by mass, still more preferably 2,000 ppm by mass, yet still more preferably 1,500 ppm by mass, and particularly preferably 1,200 ppm by mass, from the viewpoint of volume resistivity.

When insulation performance and cooling performance are required in addition to lubricity as in the electric drive unit, a sulfur-based extreme pressure resistance agent is required in order to improve lubricity under an extreme pressure of the gear, but when a content of sulfur atoms in the lubricating oil composition increases, wear resistance deteriorates. On the other hand, although addition of a phosphorus-based anti-wear agent improves the wear resistance, a volume resistivity (Ω·m) tends to deteriorate as an amount of additives including contents of phosphorus atoms and sulfur atoms in the lubricating oil composition increases. According to the present invention, the problems of the present invention are solved by using the phosphite ester derivative (A) and the thiadiazole derivative (B) having sulfur atoms, and it is also preferable to adjust respective contents of the phosphite ester derivative (A) and the thiadiazole derivative (B), and it is also preferable to optimize the $X_{AP}/X_{BS}$, and to optimize a sum of the sulfur atom-equivalent content of the phosphite ester derivative (A) and the sulfur atom-equivalent content of the thiadiazole derivative (B).

<$X_{AP}/X_{BS}$>

It is also preferable to optimize $X_{AP}/X_{BS}$, which is a quotient of the $X_{AP}$ and the $X_{BS}$.

A lower limit of $X_{AP}/X_{BS}$ is preferably 0.05, more preferably 0.10, still more preferably 0.15, and yet still more preferably 0.20, from the viewpoint of exhibiting lubricity under extreme pressure, and an upper limit thereof is preferably 5.00, more preferably 2.00, still more preferably 1.00, yet still more preferably 0.80, and particularly preferably 0.50, from the viewpoint of volume resistivity.

<$X_{AS}+X_{BS}$>

The sum of the sulfur atom-equivalent content ($X_{AS}$) of the phosphite ester derivative (A) and the sulfur atom-equivalent content ($X_{BS}$) of the thiadiazole derivative (B) is preferably equal to or more than an upper limit from the viewpoint of lubricity under extreme pressure, and is preferably equal to or less than an upper limit from the viewpoint of wear resistance. The lower limit is preferably 100 ppm by mass, more preferably 600 ppm by mass, still more preferably 800 ppm by mass, yet still more preferably 1,000 ppm by mass, and particularly preferably 1,200 ppm by mass. The upper limit is preferably 10,000 ppm by mass, more preferably 8,000 ppm by mass, further preferably 5,000 ppm by mass, still more preferably 3,000 ppm by mass, even more preferably 2,000 ppm by mass, yet still more preferably 1,800 ppm by mass, even still more preferably 1,500 ppm by mass, and particularly preferably 1,400 ppm by mass.

<Base Oil (C)>

A base oil (C) used in the lubricating oil composition according to the present invention is not particularly limited, and one or more selected from mineral oils and synthetic oils that can be used as a lubricant base oil can be used.

<Mineral Oil>

Examples of the mineral oil include: an atmospheric residual oil obtained by atmospheric distillation of a crude oil such as a paraffinic crude oil, an intermediate base crude oil, and a naphthenic crude oil; a distillate oil obtained by vacuum distillation of the atmospheric residual oil; a mineral oil obtained by subjecting the distillate oil to one or more refining treatments such as solvent deasphalting, solvent extraction, hydrocracking, solvent dewaxing, catalytic dewaxing, and hydrorefining; and a mineral oil obtained by isomerizing wax (gas to liquids wax (GTL wax)) produced by a Fischer-Tropsch method or the like.

These mineral oils may be used alone or in combination of two or more thereof.

The mineral oil may be classified into any of Groups 1, 2, and 3 in a base oil category of American Petroleum Institute (API), and is preferably classified into Groups 2 and 3 from a viewpoint of further inhibiting sludge formation and further improving viscosity characteristics and stability against oxidative degradation and the like.

Examples of the synthetic oil include: poly-α-olefins such as polybutene, an α-olefin homopolymer, and an α-olefin copolymer (for example, an ethylene-α-olefin copolymer); various ester oils such as a polyol ester, a dibasic acid ester, and a phosphoric acid ester; various ethers such as polyphenyl ether; polyglycol; alkylbenzenes; and alkylnaphthalenes.

As the lubricant base oil (C), the mineral oils described above may be used alone or in combination of two or more thereof. These synthetic oils may be used alone or in combination of two or more thereof. One or more of the mineral oils and one or more of the synthetic oils may be used in combination.

A kinematic viscosity and a viscosity index of the lubricant base oil (C) are not particularly limited, and the kinematic viscosity and the viscosity index are preferably in the following ranges from a viewpoint of further improving lubricity of the lubricating oil composition and further improving handleability of the lubricant base oil.

That is, a 100° C. kinematic viscosity of the lubricant base oil (C) is preferably 1 $mm^2/s$ or more and 50 $mm^2/s$ or less, more preferably 2 $mm^2/s$ or more and 20 $mm^2/s$ or less, and still more preferably 3 $mm^2/s$ or more and 10 $mm^2/s$ or less.

A 40° C. kinematic viscosity of the lubricant base oil (C) is preferably 1 $mm^2/s$ or more and 80 $mm^2/s$ or less, more preferably 5 $mm^2/s$ or more and 50 $mm^2/s$ or less, and still more preferably 10 $mm^2/s$ or more and 30 $mm^2/s$ or less.

The viscosity index of the lubricant base oil (C) is preferably 100 or more, more preferably 110 or more, and still more preferably 120 or more.

In the present specification, the kinematic viscosity and the viscosity index are values measured using a glass capillary viscometer according to JIS K 2283: 2000.

<Other Components>

The lubricating oil composition according to one aspect of the present invention may contain other additives as long as effects of the present invention are not impaired.

Examples of other additives include an anti-foaming agent, a viscosity index improver, an anti-wear agent, an extreme pressure agent, an antioxidant, a dispersant, and a metal deactivator.

These may be used alone or in combination of two or more thereof.

[Phosphite Ester Other than Phosphite Ester (A)]

A phosphite ester having no sulfur atom in the molecule other than the phosphite ester (A) may be further contained.

Examples thereof include mono- or di-ethyl hydrogen phosphite, mono- or di-n-propyl hydrogen phosphite, mono- or di-n-butyl hydrogen phosphite, mono- or di-2-ethylhexyl hydrogen phosphite, mono- or di-lauryl hydrogen phosphite, mono- or di-oleyl hydrogen phosphite, mono- or di-stearyl hydrogen phosphite, and mono- or di-phenyl hydrogen phosphite.

An amine salt such as a phosphate ester, an acidic phosphate ester, a phosphite ester, and a hydrogen phosphite ester used in the present invention are preferable, and examples of amines used for forming the amine salt include primary amines, secondary amines, tertiary amines, and polyalkylene amines, such as ethylenediamine, diethylenetriamine, triethylenetetramine, tetraethylenepentamine, pentaethylenehexamine, hexaethyleneheptamine, heptaethyleneoctamine, tetrapropylenepentamine, and hexabutyleneheptamine.

[Benzotriazole Derivative]

A benzotriazole derivative may be further contained as a metal deactivator. Benzotriazole is preferably contained since benzotriazole improves copper corrosion resistance.

The benzotriazole derivative is preferably a compound represented by the general formula (D).

(D)

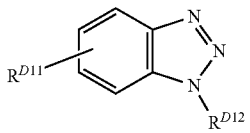

(In the formula, $R^{D11}$ and $R^{D12}$ each independently represent a hydrogen atom or an organic group.)

The organic group is preferably an alkyl group having 1 or more and 20 or less carbon atoms, and one or more —$CH_2$— may be substituted with —O—, —S—, —COO—, —OCO—, —CSO—, —OCS—, —CH═CH— or —C≡C—. The organic group may be linear or branched, and is preferably linear. The number of carbon atoms in the organic group is more preferably 1 or more, and still more preferably 2 or more, and is still more preferably 8 or less, yet still more preferably 4 or less, and even still more preferably 2 or less. $R^{D11}$ is preferably a hydrogen atom or a methyl group, and $R^{D12}$ is preferably a hydrogen atom or a methyl group.

It is also preferable to optimize a content in order to improve these characteristics. A lower limit of the content of the benzotriazole derivative is preferably 0.005% by mass and more preferably 0.008% by mass, from a viewpoint of improving copper corrosion resistance, and an upper limit thereof is preferably 0.5% by mass, more preferably 0.1% by mass, still more preferably 0.08% by mass, yet still more preferably 0.05% by mass, and particularly preferably 0.02% by mass, from the viewpoint of exhibiting lubricity, based on the total amount of the lubricating oil composition.

[Antioxidant]

Examples of the antioxidant include an amine-based antioxidant, a phenol-based antioxidant, a molybdenum-based antioxidant, a sulfur-based antioxidant, and a phosphorus-based antioxidant.

Examples of the amine-based antioxidant include: diphenylamine-based antioxidants such as diphenylamine and alkylated diphenylamine having an alkyl group having 3 or more and 20 or less carbon atoms; and naphthylamine-based antioxidants such as α-naphthylamine, phenyl-α-naphthylamine, and substituted phenyl-α-naphthylamine having an alkyl group having 3 or more and 20 or less carbon atoms.

Examples of the phenol-based antioxidant include: monophenol-based antioxidants such as 2,6-di-t-butylphenol, 2,6-di-t-butyl-4-methylphenol, 2,6-di-t-butyl-4-ethylphenol, isooctyl-3-(3,5-di-t-butyl-4-hydroxyphenyl)propionate and octadecyl-3-(3,5-di-t-butyl-4-hydroxyphenyl)propionate; diphenol-based antioxidants such as 4,4'-methylenebis(2,6-di-t-butylphenol) and 2,2'-methylenebis(4-ethyl-6-t-butylphenol); and hindered phenol-based antioxidants.

Examples of the molybdenum-based antioxidant include molybdenum amine complexes obtained by reaction of molybdenum trioxide and/or molybdic acid with an amine compound.

Examples of the sulfur-based antioxidant include dilauryl-3,3'-thiodipropionate.

Examples of the phosphorus-based antioxidant include phosphites.

In the aspect of the present invention, these antioxidants may be used alone or in combination of two or more thereof, and it is preferable to use two or more thereof in combination, and it is more preferable to use both the amine-based antioxidant and the phenol-based antioxidant.

When the lubricating oil composition according to the aspect of the present invention contains an antioxidant, a lower limit of a content of the antioxidant is preferably 0.01% by mass, more preferably 0.05% by mass, still more preferably 0.1% by mass, and yet still more preferably 0.2% by mass, and an upper limit thereof is preferably 15.00% by mass, more preferably 10.00% by mass, still more preferably 5.00% by mass, and yet still more preferably 2.00% by mass, based on the total amount (100% by mass) of the lubricating oil composition.

[Anti-Foaming Agent]

Examples of the anti-foaming agent include a silicone oil, a fluorosilicone oil, and a fluoroalkyl ether.

[Viscosity Index Improver]

Examples of the viscosity index improver include polymers such as non-dispersant-type polymethacrylates, dispersant-type polymethacrylates, olefin-based copolymers (for example, ethylene-propylene copolymers), dispersant-type olefin-based copolymers, and styrene-based copolymers (for example, styrene-diene copolymers and styrene-isoprene copolymers).

<Various Physical Properties of Lubricating Oil Composition>

The lubricating oil composition according to the aspect of the present invention preferably has a 100° C. kinematic viscosity, a 40° C. kinematic viscosity, and a viscosity index in ranges described below, from a viewpoint of improving the lubricating oil composition in high-temperature detergency, base number retention, and lifetime. The 40° C. kinematic viscosity, the 100° C. kinematic viscosity, and the viscosity index of the lubricating oil composition are values measured and calculated according to JIS K2283-2000.

[100° C. Kinematic Viscosity of Lubricating Oil Composition]

The 100° C. kinematic viscosity of the lubricating oil composition according to the aspect of the present invention is preferably 1 $mm^2/s$ or more and 50 $mm^2/s$ or less, more preferably 2 $mm^2/s$ or more and 20 $mm^2/s$ or less, and still more preferably 3 $mm^2/s$ or more and 10 $mm^2/s$ or less.

[40° C. Kinematic Viscosity of Lubricating Oil Composition]

The 40° C. kinematic viscosity of the lubricating oil composition according to the aspect of the present invention is preferably 1 $mm^2/s$ or more and 80 $mm^2/s$ or less, more preferably 5 $mm^2/s$ or more and 50 $mm^2/s$ or less, and still more preferably 10 $mm^2/s$ or more and 30 $mm^2/s$ or less.

[Viscosity Index of Lubricating Oil Composition]

The viscosity index of the lubricating oil composition according to the aspect of the present invention is preferably 100 or more, more preferably 110 or more, and still more preferably 120 or more.

[Electric Drive Unit]

The electric drive unit includes an electric motor, a gear box, and an inverter mounted on a fuel cell vehicle, an electric vehicle, or a hybrid vehicle. The lubricating oil composition according to the present invention is preferably used to cool the electric motor and lubricate the gear box.

EXAMPLES

Next, the present invention will be described in more detail with reference to Examples, but the present invention is not limited to these examples.

Examples 1 to 5 and Comparative Examples 1 to 9

Lubricating oil compositions were prepared at the blending ratio (% by mass) shown in Table 1. The resultant gear oil compositions were subjected to various tests according to the following methods to evaluate physical properties thereof. The evaluation results are shown in Table 1. Since the kinematic viscosity of the lubricating oil composition affects extreme pressure resistance and wear resistance, comparative evaluation was performed on the kinematic viscosities of Examples 1 and 3 to 5 and Comparative Examples 1 to 9.

The properties of the lubricating oil composition were measured by the following method.

(1) Kinematic Viscosity

The kinematic viscosities at 40° C. and 100° C. were measured according to ASTM D455.

(2) Viscosity Index (VI)

Measured according to ASTM D2270.

(3) Content of Phosphorus Atoms

Measured according to ASTM D4951.

(4) Content of Sulfur Atoms

Measured according to ASTM D5453.

(5) Measurement of FZG Scuffing Test (A10/16.6R/90)

According to ASTM D5182, using an A10 type gear, under conditions of a sample oil temperature of 90° C., a rotation speed of 2,900 rpm, and an operation time of approximately 7.5 minutes, a load was increased stepwise according to regulations, and a stage of the load when scuffing occurred was determined.

(6) Measurement of Wear Track Diameter

According to ASTM D4172, a wear track diameter (mm) of a fixed ball after the test was measured in the shell four-ball wear test performed at an oil temperature of 80° C., a rotation speed of 1800 rpm, a load of 392 N, and a test time of 30 minutes using a 20-grade SUJ-2 0.5-inch ball.

(7) Copper Corrosion Resistance: Copper Elution Amount

The ISOT test was performed according to JIS K-2514 "lubricating oil-oxidation stability test". That is, an iron-copper plate was put into the oil and the mixture was stirred at 150° C., and an amount of copper eluted after 72 hours was measured by ASTM D4951.

(8) Volume Resistivity

Measured at room temperature of 80° C. according to 24 of JIS C 2101 (volume resistivity test).

TABLE 1

| | Unit | Example 1 | Example 2 | Example 3 | Example 4 | Example 5 |
|---|---|---|---|---|---|---|
| 60N hydrocracked mineral oil | % by mass | 75.50 | 20.00 | 74.50 | 75.60 | 74.74 |
| 70N hydrocracked mineral oil | % by mass | 0.78 | 0.78 | 1.17 | 0.78 | 0.78 |
| 100N hydrocracked mineral oil | % by mass | | 74.00 | | | |
| 150N hydrocracked mineral oil | % by mass | 18.50 | | 18.50 | 18.50 | 18.50 |
| (A1-1) | % by mass | 0.27 | 0.27 | 0.40 | 0.27 | 0.95 |
| (A2-1) | % by mass | 0.03 | 0.03 | 0.05 | 0.03 | 0.11 |
| (B-1) | % by mass | 0.30 | 0.30 | 0.30 | 0.20 | 0.30 |
| 300TBN Ca sulfonate | % by mass | 0.10 | 0.10 | 0.10 | 0.10 | 0.10 |
| Polymethacrylate | % by mass | 0.10 | 0.10 | 0.10 | 0.10 | 0.10 |
| Alkylated diphenylamine | % by mass | 0.20 | 0.20 | 0.20 | 0.20 | 0.20 |
| Hindered phenol | % by mass | 0.30 | 0.30 | 0.30 | 0.30 | 0.30 |
| Benzotriazole | % by mass | 0.01 | 0.01 | 0.01 | 0.01 | 0.01 |
| Other compounds | % by mass | 3.91 | 3.91 | 4.37 | 3.91 | 3.91 |
| Total | % by mass | 100.00 | 100.00 | 100.00 | 100.00 | 100.00 |
| Content of (A) | % by mass | 0.30 | 0.30 | 0.45 | 0.30 | 1.06 |
| (A1)/(A) | | 0.90 | 0.90 | 0.89 | 0.90 | 0.90 |
| $X_{AP}$ | ppm by mass | 300 | 300 | 450 | 300 | 1050 |
| $X_{BS}$ | ppm by mass | 1000 | 1000 | 1000 | 667 | 1000 |

TABLE 1-continued

| | Unit | Example 1 | Example 2 | Example 3 | Example 4 | Example 5 |
|---|---|---|---|---|---|---|
| $X_{AP}/X_{BS}$ | | 0.30 | 0.30 | 0.45 | 0.45 | 1.05 |
| $X_{AS} + X_{BS}$ | ppm by mass | 1322 | 1322 | 1483 | 989 | 2152 |
| 40° C. kinematic viscosity | $mm^2/s$ | 11.3 | 17.8 | 11.3 | 11.2 | 11.4 |
| 100° C. kinematic viscosity | $mm^2/s$ | 3.0 | 4.0 | 3.0 | 3.0 | 3.0 |
| FZG (A10/16.6R/90) | FLS | 8 | 9 | 8 | 7 | 8 |
| Wear track diameter | mm | 0.47 | 0.47 | 0.49 | 0.48 | 0.46 |
| Copper elution amount | ppm by mass | 29 | 30 | 30 | 14 | 30 |
| Volume resistivity | $\times 10^7$ Ωm | 3.00 | 4.00 | 2.40 | 3.60 | 1.90 |

TABLE 2

| | Unit | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|---|
| 60N hydrocracked mineral oil | % by mass | 75.95 | 76.31 | 76.29 | 75.98 | 76.27 | 76.32 | 76.20 | 76.07 | 75.80 |
| 70N hydrocracked mineral oil | % by mass | | | | | | | | | 0.78 |
| 100N hydrocracked mineral oil | % by mass | | | | | | | | | |
| 150N hydrocracked mineral oil | % by mass | 18.50 | 18.50 | 18.50 | 18.50 | 18.50 | 18.50 | 18.50 | 18.50 | 18.50 |
| (A1-1) | % by mass | — | — | — | — | — | — | — | — | 0.27 |
| (A2-1) | % by mass | — | — | — | — | — | — | — | — | 0.03 |
| (B-1) | % by mass | 0.30 | 0.30 | 0.30 | 0.30 | 0.30 | 0.30 | 0.30 | 0.30 | — |
| 300TBN Ca sulfonate | % by mass | 0.10 | 0.10 | 0.10 | 0.10 | 0.10 | 0.10 | 0.10 | 0.10 | 0.10 |
| Polymethacrylate | % by mass | 0.10 | 0.10 | 0.10 | 0.10 | 0.10 | 0.10 | 0.10 | 0.10 | 0.10 |
| Alkylated diphenylamine | % by mass | 0.20 | 0.20 | 0.20 | 0.20 | 0.20 | 0.20 | 0.20 | 0.20 | 0.20 |
| Hindered phenol | % by mass | 0.30 | 0.30 | 0.30 | 0.30 | 0.30 | 0.30 | 0.30 | 0.30 | 0.30 |
| Benzotriazole | % by mass | 0.01 | 0.01 | 0.01 | 0.01 | 0.01 | 0.01 | 0.01 | 0.01 | 0.01 |
| Other compounds | % by mass | 3.91 | 3.91 | 3.91 | 3.91 | 3.91 | 3.91 | 3.91 | 3.91 | 3.91 |
| Comparative compound 1 | % by mass | 0.63 | | | | | | | | |
| Comparative compound 2 | % by mass | | 0.27 | | | | | | | |
| Comparative compound 3 | % by mass | | | 0.29 | | | | | | |
| Comparative compound 4 | % by mass | | | | 0.60 | | | | | |
| Comparative compound 5 | % by mass | | | | | 0.31 | | | | |
| Comparative compound 6 | % by mass | | | | | | 0.26 | | | |
| Comparative compound 7 | % by mass | | | | | | | 0.38 | | |
| Comparative compound 8 | % by mass | | | | | | | | 0.51 | |
| Total | % by mass | 100.00 | 100.00 | 100.00 | 100.00 | 100.00 | 100.00 | 100.00 | 100.00 | 100.00 |
| Content of (A) | % by mass | — | — | — | — | — | — | — | — | 0.30 |
| (A1)/(A) | | — | — | — | — | — | — | — | — | 0.90 |
| $X_{AP}$ | ppm by mass | — | — | — | — | — | — | — | — | 300 |
| $X_{BS}$ | ppm by mass | 1000 | 1000 | 1000 | 1000 | 1000 | 1000 | 1000 | 1000 | 0 |
| $X_{AP}/X_{BS}$ | | — | — | — | — | — | — | — | — | — |
| $X_{AS} + X_{BS}$ | ppm by mass | 1000 | 1000 | 1000 | 1000 | 1000 | 1000 | 1000 | 1000 | 322 |
| 40° C. kinematic viscosity | $mm^2/s$ | 11.4 | 11.1 | 11.2 | 11.3 | 11.3 | 11.1 | 11.2 | 11.2 | 11.2 |
| 100° C. kinematic viscosity | $mm^2/s$ | 3.0 | 2.9 | 3.0 | 3.0 | 3.0 | 2.9 | 3.0 | 3.0 | 3.0 |
| FZG (A10/16.6R/90) | FLS | 8 | 8 | 8 | 8 | 8 | 8 | 8 | 8 | 4 |
| Wear track diameter | mm | 0.70 | 0.67 | 0.64 | 0.66 | 0.85 | 0.84 | 0.77 | 0.69 | 0.46 |
| Copper elution amount | ppm by mass | 31 | 35 | 399 | 30 | 31 | 22 | 20 | 17 | 11 |
| Volume resistivity | $\times 10^7$ Ωm | 6.00 | 6.40 | 4.80 | 5.60 | 6.00 | 4.40 | 5.20 | 6.20 | 4.30 |

The abbreviations in the table represent the following.

(A1-1): a compound represented by the general formula (A1) in which $R^{A11}$ is a $C_8H_{17}$— group, and $a^{A11}$ is 2.

(A2-1): a compound represented by the general formula (A2) in which each of $R^{A21}$ and $R^{A22}$ is a $C_8H_{17}$— group, and each of $a^{A21}$ and $a^{A22}$ is 2.

(B-1): a compound represented by the general formula (B1) in which $R^{B11}$ and $R^{B12}$ are both —$X^{B41}$—$R^{B41}$, $X^{B41}$ is —S—S—, and $R^{B41}$ is a branched alkyl group having 9 carbon atoms.

300TBN Ca Sulfonate: Ca sulfonate having a branched non-acyclic hydrocarbon group, base number: 300 mgKOH/g (overbased salt), Ca atom content: 12% by mass Polymethacrylates non-dispersant-type, weight average molecular weight (Mw): 50,000

Alkylated diphenylamine: "IRGANOX L57", manufactured by BASF

Hindered phenol: "IRGANOX L135", manufactured by BASF

Benzotriazole: "TT-130F", manufactured by Johoku Chemical Co., Ltd.

Other compounds: succinimide, alkylated dip henylamine, polybutenylsuccinic acid bisimide (Mw: 960), hydrogen phosphite, thiadiazole, hindered phenol, calcium-based detergent, succinimide, glycerin fatty acid ester, and silicone-based anti-foaming agent Comparative compound 1: tris[(2 or 4)isoalkyl(C9 and C10)phenol]-thiophosphate Comparative compound 2: O,O-diisopropyl dithiophosphate-S-(2-ethoxycarbonylethyl)

Comparative compound 3: 3-[[bis(2-methylpropoxy) phosphinothioil]thio]-2-methyl-propionic acid Comparative compound 4: tris(nonylphenyl)phosphite Comparative compound 5: tricresyl phosphate Comparative compound 6: dioctyl hydrogen phosphite Comparative compound 7: dilauryl hydrogen phosphite Comparative compound 8: dioleyl hydrogen phosphite $X_{AP}$: phosphorus atom-equivalent content (ppm by mass) of phosphite ester derivative (A) based on total amount of lubricating oil composition $X_{AS}$: sulfur atom-equivalent content (ppm by mass) of phosphite ester derivative (A) based on total amount of lubricating oil composition $X_{BP}$: phosphorus atom-equivalent content (ppm by mass) of thiadiazole derivative (B) based on total amount of lubricating oil composition $X_{BS}$: sulfur atom-equivalent content (ppm by mass) of thiadiazole derivative (B) based on total amount of lubricating oil composition 40° C. kinematic viscosity: kinematic viscosity at 40° C.

100° C. kinematic viscosity: kinematic viscosity at 100° C.

FZG (A10/16.6R/90): stage of load when scuffing occurred in FZG scuffing test (A10/16.6R/90)

From the results shown in Table 1, it was found that lubricating oil compositions according to Examples 1 to 5 had excellent characteristics.

On the other hand, it was found that lubricating oil compositions according to Comparative Examples 1 to 8, which did not contain the phosphite ester derivative (A) and contained the comparative compounds 1 to 8, were all inferior to the compositions according to Examples in terms of the wear track diameter and volume resistivity.

It was found that when a sulfur atom was introduced into the molecule as a phosphinothio group as in the comparative compound 3 used in the lubricating oil composition according to Comparative Example 3, an amount of copper eluted significantly increased.

Comparative Example 9 is a composition obtained by removing the compound corresponding to the general formula (B) from the lubricating oil composition according to Example 1. Although an amount of copper eluted was reduced, a result of the FZG scuffing test was significantly deteriorated. It was found that high extreme pressure resistance, which is an object of the present invention, could not be achieved.

As described above, it was found that the lubricating oil composition containing both the phosphite ester derivative (A) and the thiadiazole derivative (B) according to the present invention can provide a lubricating oil composition having high extreme pressure resistance and causing durability and wear resistance to be exhibited at high levels.

The invention claimed is:

1. A lubricating oil composition, comprising:

a base oil having a content in a range of 94.00% by mass to 94.88% by mass based on a total amount of the lubricating oil composition;

a phosphite ester derivative having at least one alkyl group having 1 or more and 20 or less carbon atoms in which one —$CH_2$— group is substituted with a —S— group;

a thiadiazole derivative; and a polymethacrylate having a content of 0.10% by mass or less based on the total amount of the lubricating oil composition, wherein the phosphite ester derivative includes a compound of formula (A1) and a compound of formula (A2), (A1)

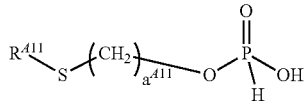

(A2)

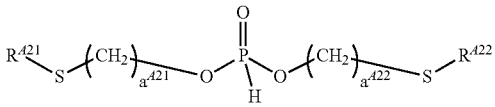

where each of $R^{A11}$, $R^{A21}$, and $R^{A22}$ is independently an alkyl group having 8 carbon atoms, and each of $a^{A11}$, $a^{A21}$, and $a^{A22}$ is independently an integer of 2, the phosphite ester derivative has a content in a range of 0.30% by mass to 1.06% by mass based on the total amount of the lubricating oil composition, and the compound of the formula (A1) has a content in a range of 89% by mass to 90% by mass based on a total amount of the phosphite ester derivative, and the thiadiazole derivative comprises a thiadiazole ring and a side chain attached to the thiadiazole ring and having a branched alkyl group, the thiadiazole derivative includes a compound of formula (B1), (B1)

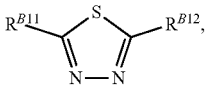

where each of $R^{B11}$ and $R^{B12}$ is independently a —$X^{B41}$—$R^{B41}$ group, where $X^{B41}$ is —S—S—, and $R^{B41}$ is a branched alkyl group having 9 carbon atoms, wherein the compound of the formula (A1) has a content in a range of 0.27% by mass to 0.95% by mass based on the total amount of the lubricating oil composition, and the compound of the formula (A2) has a content in a range of 0.03% by mass to 0.11% by mass based on the total amount of the lubricating oil composition, wherein the compound of the formula (B1) has a content of 0.20% by mass to 0.80% by mass based on the total amount of the lubricating oil composition, wherein the base oil includes at least one selected from the group consisting of 60N hydrocracked mineral oil, 70N hydrocracked mineral oil, 100N hydrocracked mineral oil and 150N hydrocracked mineral oil, wherein the 60N hydrocracked mineral oil has a content in a range of 20% by mass to 75.60% by mass based on the total amount of the lubricating oil composition, the 70N hydrocracked mineral oil has a content in a range of 0% by mass to 1.17% by mass based on the total amount of the lubricating oil composition, the 100N hydrocracked mineral oil has a content in a range of 0% by mass to 74.00% by mass based on the total amount of the lubricating oil composition, and the 150N hydrocracked mineral oil has a content in a range of 0% by mass to 18.50% by mass based on the total amount of the lubricating oil composition.

2. The lubricating oil composition according to claim 1, wherein the phosphite ester derivative has a phosphorus atom-equivalent content, $X_{AP}$ ppm by mass, in a range of 50 ppm by mass to 10,000 ppm by mass based on the total amount of the lubricating oil composition.

3. The lubricating oil composition according to claim 2, wherein the thiadiazole derivative has a sulfur atom-equivalent content, $X_{BS}$ ppm by mass, in a range of 100 ppm by mass to 10,000 ppm by mass based on the total amount of the lubricating oil composition.

4. The lubricating oil composition according to claim 3, wherein $0.05 \leq X_{AP}/X_{BS} \leq 5.00$.

5. The lubricating oil composition according to claim 1, wherein a sum of a sulfur atom-equivalent content of the phosphite ester derivative and a sulfur atom-equivalent content of the thiadiazole derivative is in a range of 100 ppm by mass to 10,000 ppm by mass based on the total amount of the lubricating oil composition.

6. A method of lubricating an electric drive unit, comprising:

applying the lubricating oil composition of claim 1.

7. An electric drive unit, comprising the lubricating oil composition of claim 1.

8. The lubricating oil composition according to claim 1, wherein the thiadiazole derivative has a content in a range of 0.20% by mass to 0.80% by mass based on the total amount of the lubricating oil composition.

9. The lubricating oil composition according to claim 1, wherein the compound of the formula (A1) has a content of 0.27% by mass based on the total amount of the lubricating oil composition, and the compound of the formula (A2) has a content of 0.03% by mass based on the total amount of the lubricating oil composition.

10. The lubricating oil composition according to claim 9, wherein the content of the phosphite ester derivative is 0.30%.

11. The lubricating oil composition according to claim 1, wherein the lubricating oil composition has an FZG value of 7-9 measured according to ASTM D5182, a copper elution amount of 14-46 ppm by mass measured according to JIS K-2514 and ASTM D4915, and a volume resistivity of $1.90\text{-}4.00 \times 10^7$ Ωm measured according to JIS C 2101.

12. The lubricating oil composition according to claim 1, wherein the lubricating oil composition has an FZG value of 7-8 measured according to ASTM D5182, a copper elution amount of 18-46 ppm by mass measured according to JIS K-2514 and ASTM D4915, and a volume resistivity of $2.80\text{-}3.50 \times 10^7$ Ωm measured according to JIS C 2101.

* * * * *